US006254136B1

(12) United States Patent
Patel

(10) Patent No.: US 6,254,136 B1
(45) Date of Patent: Jul. 3, 2001

(54) PAGE HOLDER

(75) Inventor: Vijay Jayanti Patel, Wellington (NZ)

(73) Assignee: Quality Improvements Limited, Wellington (NZ)

( * ) Notice: Subject to any disclaimer, the term of this patent is extended or adjusted under 35 U.S.C. 154(b) by 0 days.

(21) Appl. No.: 09/508,245

(22) PCT Filed: Sep. 8, 1998

(86) PCT No.: PCT/NZ98/00135

§ 371 Date: Mar. 9, 2000

§ 102(e) Date: Mar. 9, 2000

(87) PCT Pub. No.: WO99/12747

PCT Pub. Date: Mar. 18, 1999

(30) Foreign Application Priority Data

Sep. 9, 1997 (NZ) ..... 328699

(51) Int. Cl.[7] ..... B42D 9/00

(52) U.S. Cl. ..... 281/42; 24/511; 24/67.5; 24/67.9; 248/453; 248/454; 248/447; 248/448; 248/455; 248/457; 248/458; D19/34; D19/65; D19/91; 116/234; 116/236

(58) Field of Search ..... 281/42; 248/453, 248/454, 447, 448, 455, 457, 458; 24/67.5, 67.9, 511; D19/34, 65, 91; 116/234, 236

(56) References Cited

U.S. PATENT DOCUMENTS

D. 256,806 * 9/1980 Tisdale ..... D19/65
D. 269,188 * 5/1983 Tisdale ..... D19/65
D. 407,517 * 3/1999 Zeller ..... D26/60
1,862,573 * 6/1932 Grosz ..... 281/42
2,505,590 * 4/1950 Steele ..... 45/61
4,793,632 12/1988 Hoffman .
4,838,198 * 6/1989 Knox ..... 281/42
4,869,529 * 9/1989 Hoffman, Jr. ..... 281/42
6,089,609 * 7/2000 Denley ..... 281/42

FOREIGN PATENT DOCUMENTS

37459/97 3/1998 (AU) .
1086172 5/1994 (CN) .
3903543 3/1990 (DE) .
2612841 9/1988 (FR) .
10-35143 2/1998 (JP) .

* cited by examiner

*Primary Examiner*—A. L. Wellington
*Assistant Examiner*—Mark T. Henderson
(74) *Attorney, Agent, or Firm*—Dickinson Wright PLLC

(57) ABSTRACT

A page holder for holding the pages of a book in an open arrangement having an attachment means such as a spring clip for attaching the page holder to the cover or to one or more pages of the book, a holding means adapted to hold, to the cover of the open book, one or more pages on each side of the spine of the open book, and a support member connecting the attachment means to the holding means, the support member being adapted to allow movement of the holding means from a page holding position to a page releasing position, without detaching the page holder from the book, so that one or more pages of the book can be turned.

20 Claims, 5 Drawing Sheets

PAGE HOLDER

FIELD OF INVENTION

This invention relates to a page holder, in particular, a page holder for holding the pages of a book in an open arrangement. The page holder is also useful as a book marker.

BACKGROUND

When a book, especially a paperback book, is open at a desired page, the pages of the book have a tendency to flip over by themselves which is frustrating to the reader. To prevent the pages from flipping over, it is generally necessary when reading a book, to hold the book backwards against the binding and thus damaging the spine of the book.

Page holders designed to hold open the pages of a book are known. They generally have a means for engagement with the book such as arms or prongs. Pages of the book or the cover of the book can be inserted between the arms or the prongs. The page holder is retained in place by frictional resistance between the pages or cover and the arms or prongs. Page holders typically have an elongate body or a pair of arms which exerts pressure on the pages on each side of the spine of an open book. Thus a book can be held open at a required page.

However, in order that a page is turned, conventional page holders must be disengaged from the book, the page turned and the page holder re-engaged with the book. This procedure, requiring both hands, is cumbersome, time consuming and can be frustrating. In addition, repetitive disengagement and re-engagement of the page holder from and to the book often causes damage to the pages or the cover.

SUMMARY OF INVENTION

It is therefore an object of this invention to provide a page holder which overcomes these problems or at least provides the public with a useful alternative.

Accordingly, in one aspect of the invention there is provided a page holder for holding the pages of a book in an open arrangement having:

an attachment means for attaching the page holder to the cover or to one or more pages of the book;

a holding means having an elongate page holding member of dimensions suitable for holding, to the cover of the open book, one or more pages on each side of the spine of the open book; and an elongate support member having a substantially perpendicular orientation relative to the plane of the open book when in use, the support member being fixed at one end to the attachment means;

wherein the support member is slideably engaged with the holding means so that the location of the page holding member can be adjusted to suit different book thicknesses and wherein the page holding member is substantially perpendicular to the longitudinal axis of the support member and can be rotated about the longitudinal axis of the support member from a page holding position to a page releasing position so that one or more pages of the book can be turned without detaching the page holder from the book.

Preferably, the support member is constructed so that upon release of a force required to move the holding means from the page holding position to the page releasing position, the holding means returns to the page holding position.

It is preferred that the support member is a flexible elongate member constructed of a resilient material, such as a plastics material or a rubber or rubber-like material, or is a rigid elongate member connected to the attachment means by a resilient connector.

It is further preferred that the support member is connected to the attachment means so that the support member is substantially upright relative to the horizontal plane of the open book when the page holder is attached to the book.

Although the attachment means may be any means suitable for fixing the page holder to the book, a clip such as a spring clip or an alligator clip is preferred.

The holding means preferably comprises an arm attached at one end to the support member and engaged at the other end with a bar wherein the bar engages the surface of the one or more pages, and wherein the bar is in a substantially perpendicular arrangement to the arm.

It is preferred that the bar is slidably held within an aperture in the end of the arm. This enables the bar to be slid relative to the arm so that the bar is in the best location for holding the pages, i.e. when one side of the book is significantly thicker than the other side. When the bar is located on only one side of the book, the book can be closed and the page holder then operates as a book marker.

Preferably, the arm is attached to the support member by an adjustment means so that movement of the adjustment means along the support member causes movement of the bar relative to the cover of the book. Thus, the page holder is able to be used to hold open the pages of books of different thicknesses.

The adjustment means is preferably a concentric band slidably engaged with the support member in a firm fit so that a force is required to be applied for adjustment of the holding means relative to the support member.

Alternatively, the adjustment means may be a spring clip having a pair of lobes which when pinched together release the grip of the clip on the support member so that the location of the holding means relative to the support member can be adjusted.

In a second aspect of the invention there is provided a method of holding the pages of a book in an open arrangement with a page holder of the first aspect of this invention comprising attaching the page holder to the cover or to one or more pages of the book and adjusting the holding means relative to the support member so that the page holding member engages with the pages on each side of the spine of the open book and holds those pages to the cover of the open book.

In a third aspect of the invention there is provided a method of turning one or more pages of an open book held to the cover of the open book by a page holder of the first aspect of the invention comprising moving the page holding member from a page holding position to a page releasing position, turning the one or more pages, and returning the page holding member to the page holding position.

In another aspect of the invention there is provided a method of marking a page location in a closed book with the page holder of the first aspect of the invention comprising attaching the page holder to the cover or to one or more pages of the book when in an open arrangement, adjusting the holding means relative to the support member so that the page holding member engages with the pages on each side of the spine of the open book, rotating the page holding member by approximately 90° about the longitudinal axis of the support member so that a portion of the page holding member lies substantially parallel to the spine of the book on one side of the spine, and closing the book.

BRIEF DESCRIPTION OF DRAWINGS

The invention is now described by way of example with reference to the accompanying drawings in which.

DETAILED DESCRIPTION

One embodiment of the invention is shown in FIGS. 1 to 6.

Figure 1:
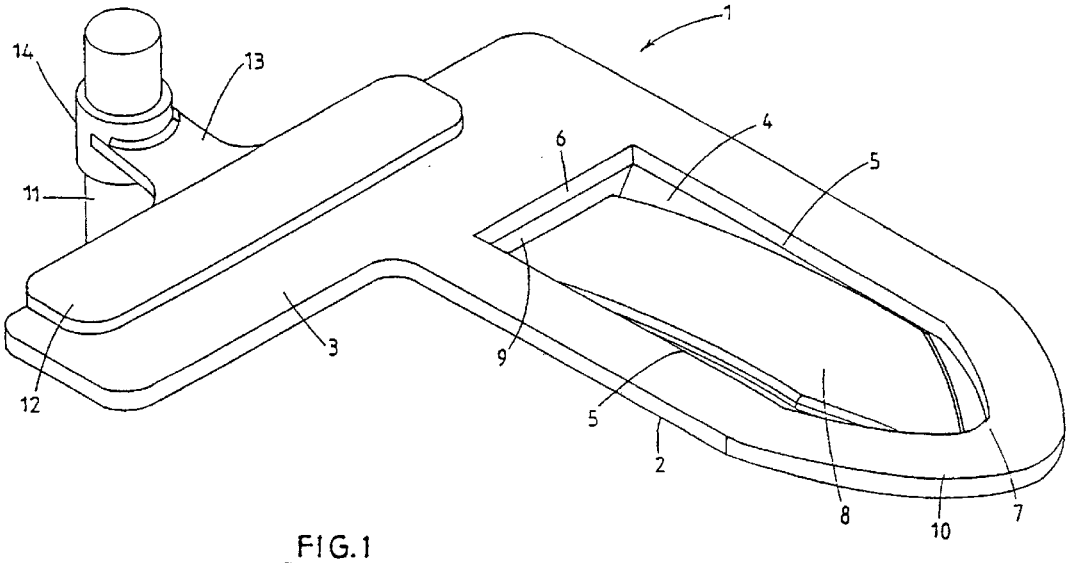
FIG. 1 is a perspective view from above of a page holder of a first embodiment of the invention.
Figure 2:
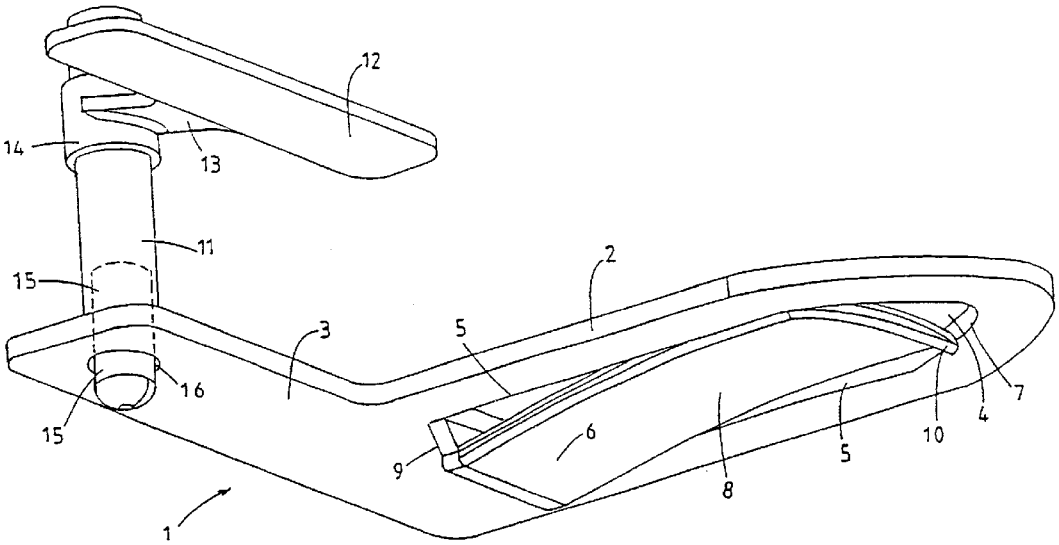
FIG. 2 is a perspective view from below of the page holder shown in FIG. 1.
Figure 3:
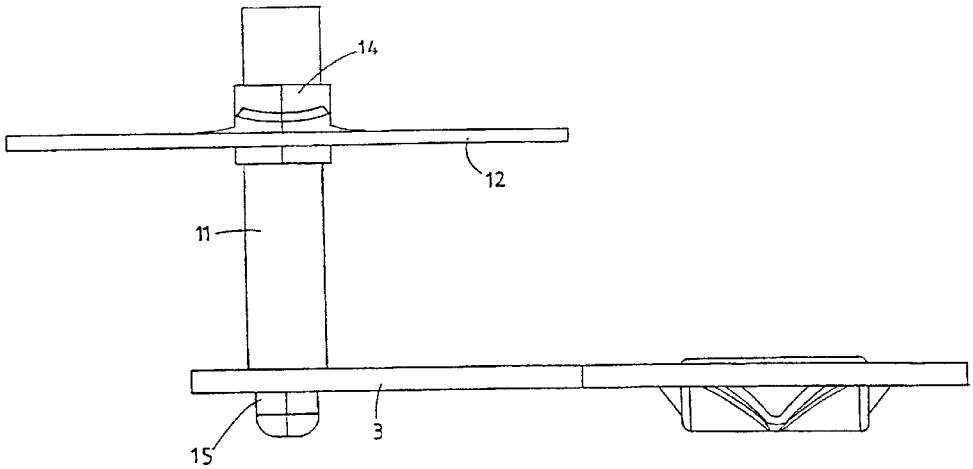
FIG. 3 is a front end view of the page holder shown in FIG. 1.
Figure 4:
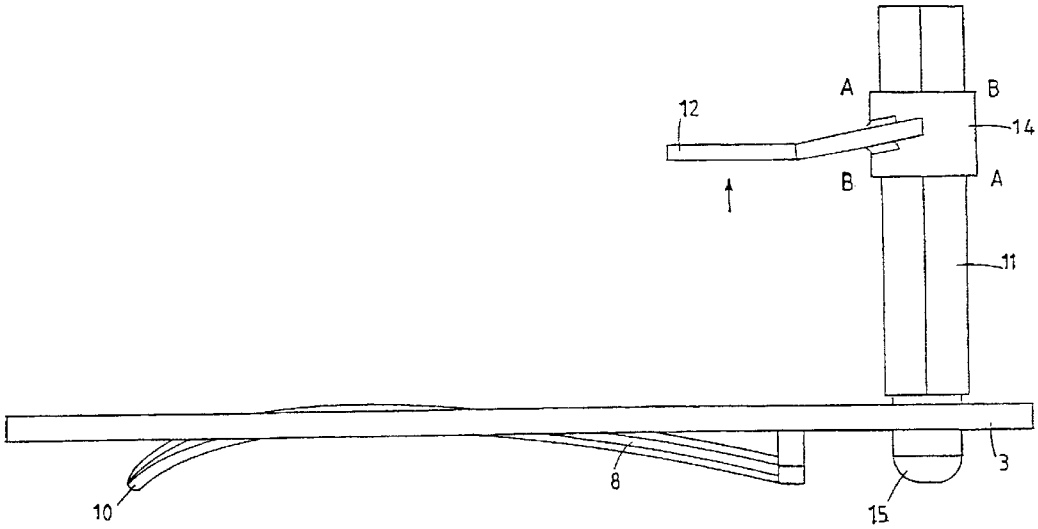
FIGS. 4 and 5 are side views of the page holder shown in FIG. 1.

FIGS. 1 and 2 show a page holder 1 having an attachment means which is a spring clip 2 integrally formed with a base 3. The spring clip 2 has a cavity 4 with substantially parallel edges 5, an end edge 6, and a curved edge 7. A tongue 8 is connected to the spring clip 2 at end edge 6 of the cavity 4 by a connecting member 9. The tongue 8 is curved so that a portion of its body protrudes into the cavity 4. The spring clip 2 will be constructed of a material of sufficient strength so that an external force is needed to move the tongue 8 relative to the cavity 4 and of sufficient flexibility to allow movement of the tongue 8 relative to the cavity 4 without breaking the tongue 8 or the connecting member 9. The tip 10 of the tongue 8 projects below the plane of the spring clip 2 to facilitate engagement with the cover of a book or one or more pages of a book. The cover or one or more pages can be slid into the space between the tip 10 and the plane of the clip 2 and forced toward the end edge 6 of the cavity 4 with concomitant movement of the tongue 8 from the cavity 4. The flexibility and strength of the tongue 8 and connecting member 9 are such that the force exerted by the tongue 8 on the cover or one or more pages of the book is sufficient to hold the page holder 1 to the book.

At a location on the base 3 distal from the clip 2 there extends a cylindrical support member 11 substantially perpendicular to the base 3. A holding means 12 which is an elongate planar member is connected to the support member 11 through an arm 13 and a concentric band 14. The internal diameter of the band 14 is predetermined to provide a snug fit about support member 11. The band 14 can be rotated relative to the support member 11 or moved longitudinally relative to the support member 11. The outer surface of the support member 11 and the inner surface of the band 14 may be textured or ribbed so that the band 14 grips the support member 11.

The holding means 12 is sufficiently long so that when the page holder 1 is fixed near to the spine of a book, the holding means engages with pages on both sides of the spine. Typically, the holding means has a length of 70–80 mm and a width of approximately 15 mm.

Figure 5:
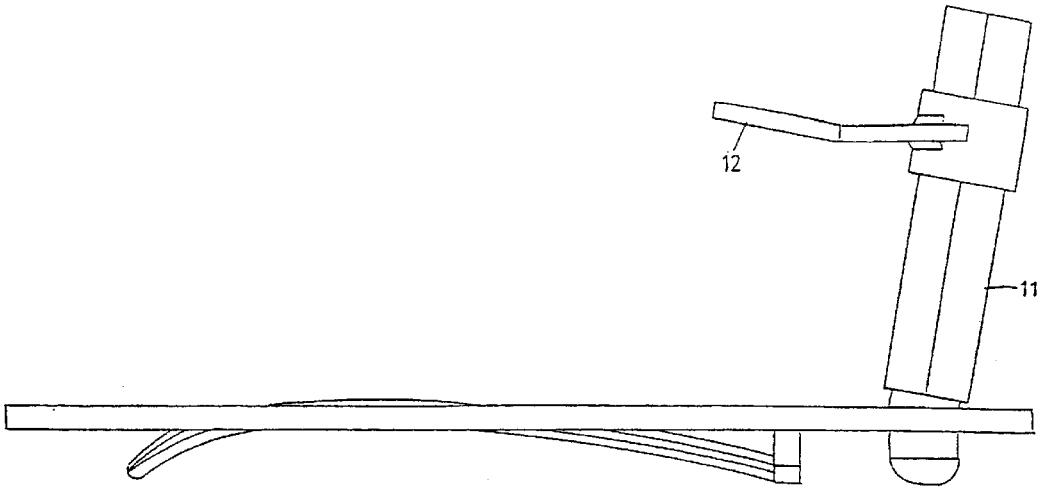
Figure 6:
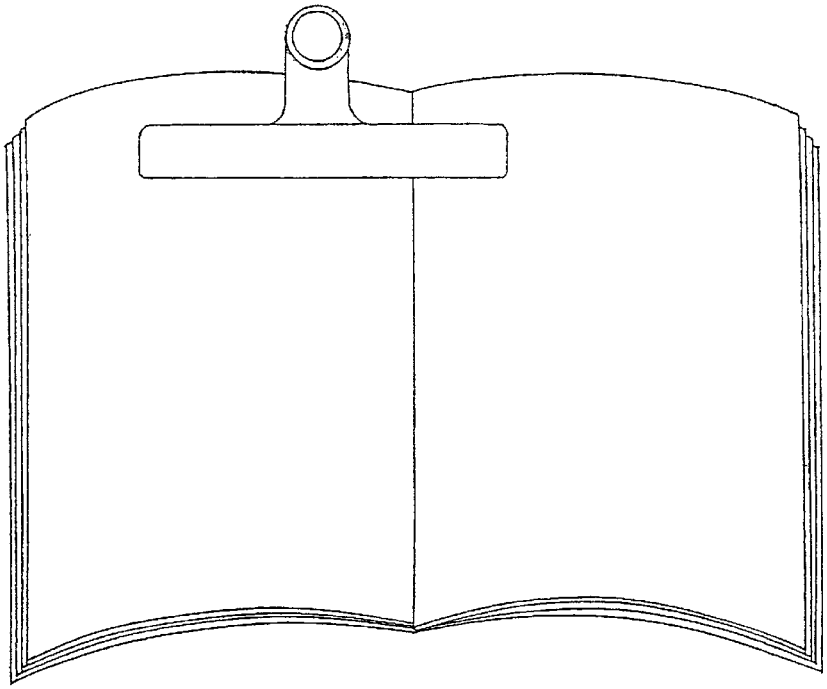
FIG. 6 is a perspective view of the page holder shown in FIG. 1 and an open book.

The support member 11 is connected to the base 3 by a resilient connector 15, as shown in FIG. 2. The connector 15 protrudes through a hole 16 in the base 3 and into the hollow centre of support member 11, as shown by the dotted line in FIG. 2. The dimensions of the diameter of the connector 15, the diameter of the hole 16 and the internal diameter of support member 11 are such that there is a tight fit. The resilience of connector 15 enables the holding means 12 to be moved from a page holding position to a page releasing position when a force is exerted perpendicular to the support member 11 at a location on the support member 11 distal from the base 3, as shown in FIG. 5. Thus, when the page holder 1 is attached to a book, the support member 11 can be bent away from the book thereby moving the holding means 12 to a page releasing position enabling one or more pages of the book to be turned. When the force exerted on the support member 11 is released, the resilience of connector 15 causes the support member 11 to return to a substantially upright position and the holding means 12 to return to the page holding position.

Alternatively, the holding means 12 can be moved from a page holding position to a page releasing position by rotating the holding means 12 by approximately 90° to 180° about the longitudinal axis of the support member 11.

Longitudinal movement of the band 14 relative to the support member 11 increases or decreases the distance between the holding means 12 and the base 3. This enables the page holder 1 to be used with books of different thicknesses. In addition, the band 14 can be rotated about the support member 11 by approximately 90° so that the holding means 12 is perpendicular to its location shown in FIGS. 1 and 2. If a book, to which the page holder 1 is attached, is then closed, the holding means 12 serves as a book mark as a portion of the holding means 12 will lie between the pages of the closed book indicating the place where the book was last open.

The page holder 1 is preferably constructed of a rigid material, such as a plastics material. Although, the connector 15 will be constructed of a resilient material, such as a rubber or rubber-like plastics material.

Although, the support member 11 has been described as rigid and the connector 15 has been described as resilient, it is envisaged that a rigid connector 15 and a resilient support member 11 will be suitable. In that case, the support member 11 itself can be bent to move the holding means 12 from a page holding position to a page releasing position. It is also envisaged that a rigid support member 11 may be connected to the base 3 by a spring loaded hinge, rather than a connector 15.

When in use, the holding means 12 will hold the pages of a book in an open arrangement. The force exerted on the underside of the holding means 12 by the pages of the book, as shown by the arrow in FIG. 4, causes the band 14 to grip the support member 11 more strongly in the vicinity of regions A than in the vicinity of regions B. This provides additional resistance to any undesired movement of the band 14 by effectively locking the band 14 into place.

The page holder 1 may be of any suitable dimensions for use as an effective page holder or book marker. However, preferably the base 3 is approximately 100 mm in length and the spring clip is approximately 120 mm in length. The holding means 12 preferably has a length of approximately 70 mm and a width of approximately 15 mm.

The diameter of the cross-section of the support member 11 is preferably approximately 10 mm.

An alternative embodiment of the invention is shown in FIGS. 7 to 10.

Figure 7:
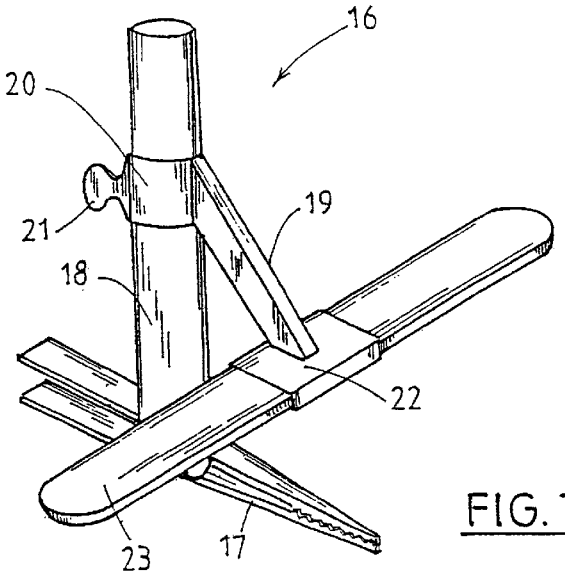
FIG. 7 is a perspective view of a page holder of a second embodiment of the invention.

FIG. 7 shows a page holder 16 having an attachment means which is an alligator clip 17. The clip 17 is located at one end of an elongate flexible shaft 18. A holding means having an arm 19 is attached at one end to the shaft 18 with an adjustable clip 20. The clip 20 has lobes 21 which can be pinched together releasing the grip of the clip 20 on the shaft 18 so that the location of the holding means on the shaft 18 can be adjusted. This is to enable the page holder 16 to be used effectively with books of varying thicknesses. At the other end of the arm 19 there is located a member 22 provided with an aperture. A flattened bar 23 is slidably engaged with the member 22 through the aperture.

Figure 8:
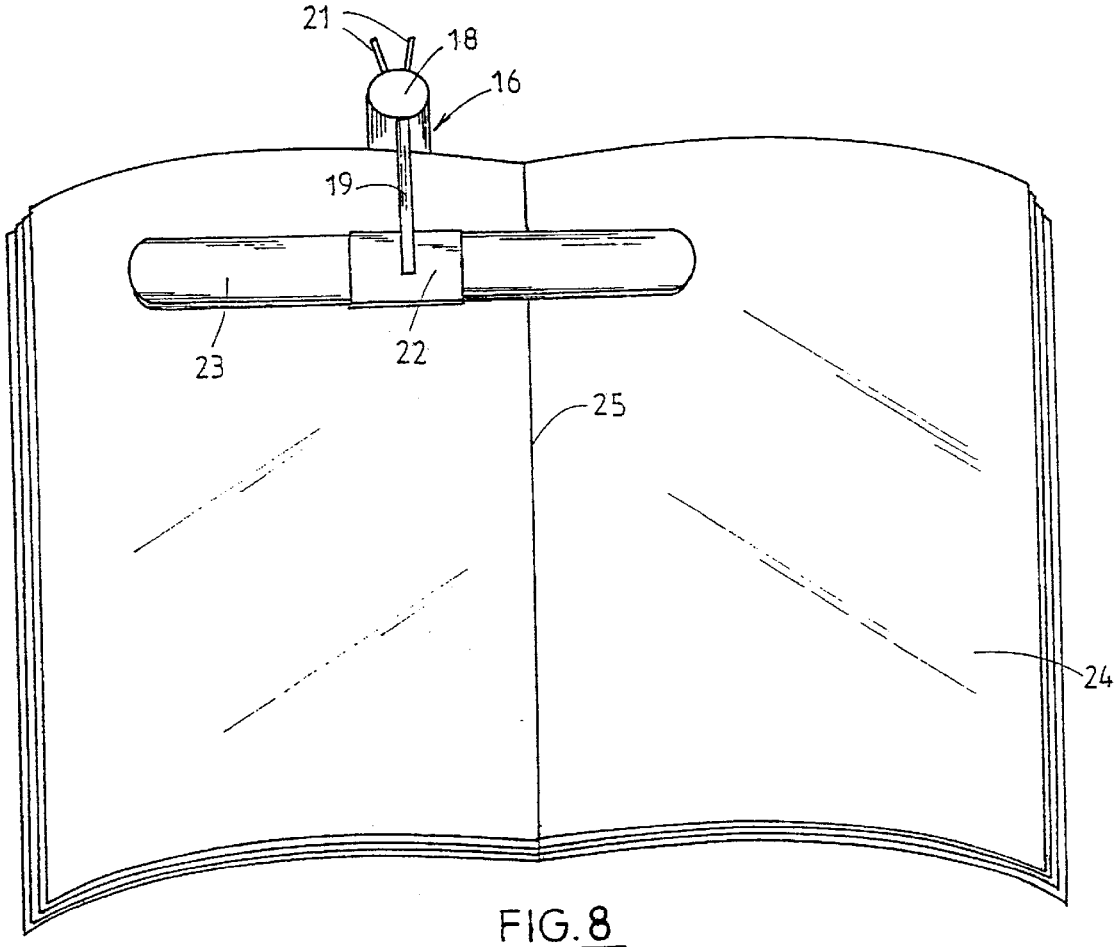
FIG. 8 is a perspective view of the page holder shown in FIG. 7 and an open book.

FIG. 8 shows an open book 24 and a page holder 16. The page holder has a shaft 18 of substantially circular cross section. The lobes 21 of the adjustable clip 20 are shown extending outwardly from shaft 18. Although not shown in FIG. 8, it will be appreciated that the page holder 16 is attached to the cover of the book with the alligator clip 17. The page holder 16 is shown at a location proximal to the spine 25 of the book 24. The bar 23 can then readily engage with the top page on both sides of the spine 25 of the book 24. In addition, the bar 23 can be slid within the aperture of member 22 to better hold the pages of the book 24 when one side of the spine 25 is thicker than the other. Furthermore, it can be seen that when the bar 23 is slid so that it engages only with the side of the spine on which the page holder 16 is attached (the left hand side in FIG. 8), the book 24 can be closed thereby enabling the page holder 16 to serve as a book marker.

Figure 9:
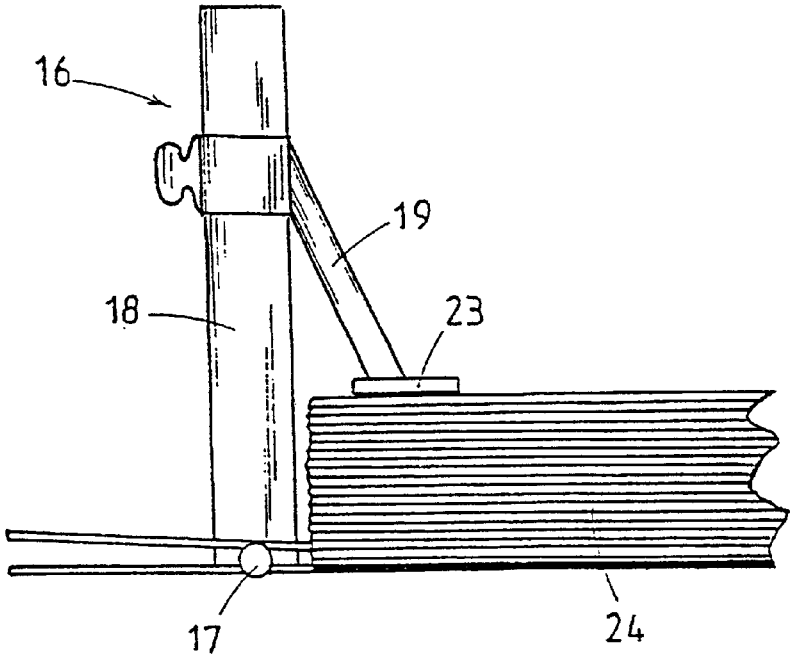
FIGS. 9 and 10 are side views of the page holder shown in FIG. 7 attached to a book.
Figure 10:
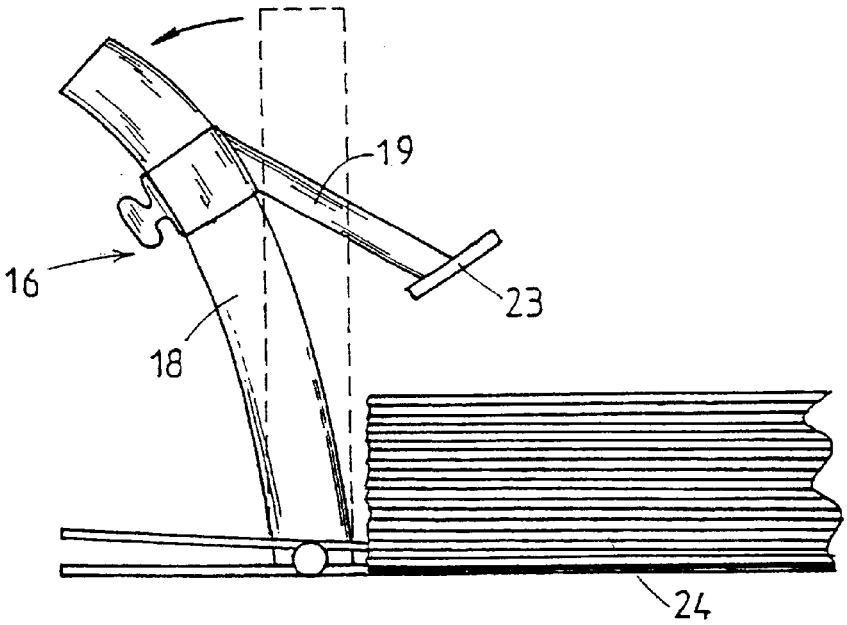

FIGS. 9 and 10 show part of the book 24 with the page holder 16 attached thereto. The jaws of the clip 17 are attached to the cover of the book 24 and hence are obscured. FIG. 9 shows the page holder 16 in a page holding position whereas FIG. 10 shows the page holder 16 in a page releasing position.

The flexible shaft 18 as shown in FIG. 10, is bent in the direction indicated by the arrow from the page holding position indicated by the dotted lines. The arm 19 and the bar 23 are therefore moved away from the pages of the book 24 thereby enabling one or more pages to be turned without needing to detach the page holder 16 from the book 24. Preferably, the bar 23 is a flattened bar approximately 100 to 160 mm long and approximately 10 to 20 mm wide.

While the page holder may be constructed of any suitable material, it is preferably constructed generally of suitable plastics materials. The flexible shaft 18 is shown having substantially circular cross section. However, the cross section may be elongate so that undesired sideways flexing of the shaft is minimised.

Although the attachment means is shown in the embodiments described as a spring clip or an alligator clip, other attachment means may be suitable. Further, it will be appreciated that the concentric band 14 in the first embodiment or the adjustable clip having lobes 21 in the second embodiment may be replaced by another suitable mechanism which allows the holding means to be adjusted relative to the support member.

Where in the foregoing description reference has been made to integers or components having known equivalents then such equivalents are incorporated as if individually set forth.

Although the invention has been described by way of example and with reference to the accompanying drawings, it will be appreciated that improvements and/or modifications may be made thereto without departing from the scope of the invention as defined in the appended claims.

INDUSTRIAL APPLICABILITY

The page holder of this invention is useful as an easy to use device for holding the pages of a book in an open arrangement and for allowing easy turning of the pages of the book without having to detach the page holder from the hook. The page holder is also useful as a book marker for marking a location in a closed book.

What is claimed is:

1. A page holder for holding the pages of a book in an open arrangement having:

an attachment means for attaching the page holder to a cover or to one or more pages of the book;

a holding means having an elongate page holding member of dimensions suitable for holding, to the cover of the open book, one or more pages on each side of a spine of the open book; and an elongate support member having a substantially perpendicular orientation relative to a plane of the open book when in use, the support member being fixed at one end to the attachment means;

wherein the support member is slideably engaged with the holding means so that the location of the page holding member can be adjusted to suit different book thicknesses and wherein the page holding member is substantially perpendicular to the longitudinal axis of the support member and can be rotated about the longitudinal axis of the support member from a page holding position to a page releasing position so that one or more pages of the book can be turned without detaching the page holder from the book.

2. A page holder as claimed in claim 1 wherein the support member is a rigid member connected to the attachment means by a resilient connector so that the holding means can be moved from the page holding position to the page releasing position without rotation of the page holding member about the longitudinal axis of the support member.

3. A page holder as claimed in claim 1 wherein the support member is a flexible member so that the holding means can be moved from the page holding position to the page releasing position without rotation of the page holding member about the longitudinal axis of the support member.

4. A page holder as claimed in claim 1 wherein the support member has a substantially circular cross section.

5. A page holder as claimed in claim 1 wherein the page holding member has dimensions so that when the holding means is rotated by approximately 90° a portion of a page holding member lies between two consecutive pages of the book when the book is closed thereby marking the page location at which the book was last open.

6. A page holder as claimed in claim 1 wherein the attachment means comprises a spring clip integrally formed with a base to which the support member is connected.

7. A method of holding the pages of a book in an open arrangement, the method comprising attaching a page holder as claimed in claim 1 to a cover or to one or more pages of the book and adjusting the holding means relative to the support member so that the page holding member engages with the pages on each side of a spine of the open book and holds those pages to the cover of the open book.

8. A method of turning one or more pages of an open book, the method comprising holding one or more pages of an open book to a cover of the open book by a page holder as claimed in claim 1, moving the page holding member from a page holding position to a page releasing position, turning the one or more pages, and returning the page holding member to the page holding position.

9. A method of marking a page location in a closed book, the method comprising attaching a page holder as claimed in claim 1 to a cover or to one or more pages of the book when in an open arrangement, adjusting the holding means relative to the support member so that the page holding member engages with the pages on each side of a spine of the open book, rotating the page holding member by approximately 90° about a longitudinal axis of the support member so that a portion of the page holding member lies substantially parallel to the spine of the book on one side of the spine, and closing the book.

10. A page holder as claimed in claim 2 wherein the support member has a substantially circular cross section.

11. A page holder as claimed in claim 10 wherein the holding means has a concentric band adapted for location of the support member therethrough, the concentric band having an internal diameter for a snug fit with the support member so that an application of an external force is required to move the holding means relative to the support means.

12. A page holder as claimed in claim 3 wherein the support member has a substantially circular cross section.

13. A page holder as claimed in claim 3 wherein the page holding member has dimensions so that when the holding means is rotated by approximately 90° a portion of the page holding member lies between two consecutive pages of the book when the book is closed thereby marking a page location at which the book was last open.

14. A page holder as claimed in claim 3 wherein the attachment means comprises a spring clip integrally formed with a base to which the support member is connected.

15. A page holder as claimed in claim 12 wherein the holding means has a concentric band adapted for location of the support member therethrough, the concentric band having an internal diameter for a snug fit with the support member so that an application of an external force is required to move the holding means relative to the support means.

16. A page holder as claimed in claim 15 wherein the concentric band is a spring clip having two lobes so that when the two lobes are pinched together the band expands allowing the holding means to be moved relative to the support member.

17. A page holder as claimed in claim 14 where the spring clip has a substantially planar body with a cavity and a curved resilient tongue, a portion of the tongue in its resting state being located within the cavity, the clip being adapted to receive the cover or one or more pages of the book between the tongue and the body thereby forcing the tongue from its resting state so that the force of the tongue on the cover or one or more pages is sufficient to hold the page holder to the book.

18. A page holder as claimed in claim 4 wherein the holding means has a concentric band adapted for location of the support member therethrough, the concentric band having an internal diameter for a snug fit with the support member so that an application of an external force is required to move the holding means relative to the support means.

19. A page holder as claimed in claim 18 wherein the concentric band is a spring clip having two lobes so that when the two lobes are pinched together the band expands allowing the holding means to be moved relative to the support member.

20. A page holder as claimed in claim 6 where the spring clip has a substantially planar body with a cavity and a curved resilient tongue, a portion of the tongue in its resting state being located within the cavity, the clip being adapted to receive the cover or one or more pages of the book between the tongue and the body thereby forcing the tongue from its resting state so that the force of the tongue on the cover or one or more pages is sufficient to hold the page holder to the book.

* * * * *